US006056803A

United States Patent [19]

Waite

[11] Patent Number: 6,056,803

[45] Date of Patent: May 2, 2000

[54] INJECTOR FOR GAS TREATMENT OF MOLTEN METALS

[75] Inventor: Peter D. Waite, Chicoutimi, Canada

[73] Assignee: Alcan International Limited, Montreal, Canada

[21] Appl. No.: 08/997,899

[22] Filed: Dec. 24, 1997

[51] Int. Cl.[7] ..... C22B 1/06

[52] U.S. Cl. ..... 75/678; 266/217; 266/235

[58] Field of Search ..... 266/217, 235; 75/678

[56] References Cited

U.S. PATENT DOCUMENTS

| | | |
|---|---|---|
| 1,921,377 | 8/1933 | Ward . |
| 2,393,685 | 1/1946 | Hunt . |
| 2,629,688 | 2/1953 | Hunter et al. . |
| 2,743,914 | 5/1956 | Epprecht . |
| 3,227,547 | 1/1966 | Szekely . |
| 3,573,895 | 4/1971 | Östberg . |
| 3,743,263 | 7/1973 | Szekely . |
| 3,767,382 | 10/1973 | Bruno et al. . |
| 3,839,019 | 10/1974 | Bruno et al. . |
| 3,849,119 | 11/1974 | Bruno et al. . |
| 3,870,511 | 3/1975 | Szekely . |
| 3,871,872 | 3/1975 | Downing et al. . |
| 3,917,242 | 11/1975 | Bass et al. . |
| 3,968,022 | 7/1976 | Eng et al. . |
| 3,972,709 | 8/1976 | Chia et al. . |
| 3,982,913 | 9/1976 | Feichtinger . |
| 4,040,610 | 8/1977 | Szekely . |

(List continued on next page.)

FOREIGN PATENT DOCUMENTS

| | | |
|---|---|---|
| 0 073 729 A1 | 3/1983 | European Pat. Off. . |
| 0 183 402 A2 | 6/1986 | European Pat. Off. . |
| 0 225 935 A1 | 6/1987 | European Pat. Off. . |
| 01259135 | 10/1989 | European Pat. Off. . |
| 0 151 434 B1 | 12/1989 | European Pat. Off. . |
| 0 365 013 A2 | 4/1990 | European Pat. Off. . |
| 2160720 | 7/1973 | France . |
| 2419123 | 10/1979 | France . |
| 2604107 | 3/1988 | France . |
| 2669041 | 5/1992 | France . |
| 19703062 C1 | 3/1998 | Germany . |
| 57-32723 | 2/1982 | Japan . |
| 1592373 A1 | 9/1990 | Russian Federation . |
| WO 86/06749 | 11/1986 | WIPO . |

OTHER PUBLICATIONS

Introduction to Hydro Metal Refining System—Hycast a.s. Jul. 1991.

*The Use of Rotating–Impeller Gas Injection in Aluminum Processing* 1208 JOM 43(1991)Sep., No. 9, Warrendale, PA, USA, p27–30.

*Purification of Molten Aluminum*—Schneider, Wolfgang. Giesserei, 81, (14) Jul. 25, pp478–483 (Original in German plus English translation).

New Melt Cleaning Technology—Hycast a.s. No Date.

*Primary Examiner*—Scott Kastler

*Attorney, Agent, or Firm*—Cooper & Duham LLP

[57] ABSTRACT

An injector for injecting gas into a molten metal. The injector has a rotor that is rotatable about an axis of rotation, the rotor having a cylindrical projection-free side surface, a bottom surface, and a cavity for receiving molten metal located centrally of the rotor with respect to the axis of rotation. The rotor is provided with a plurality of openings in the side surface spaced around the rotor for ejecting molten metal and gas from the rotor upon rotation of the rotor about the axis of rotation. At least one opening in the bottom surface communicates with the cavity permitting entry of molten metal into the cavity, and a plurality of passages disposed in the rotor interconnect the cavity and the openings in the side surface. A gas passageway introduces gas into molten metal present within the rotor but lacks direct communication with the cavity, and is provided with at least one outlet opening into at least one of the plurality of passages to ensure regular and even gas distribution. The invention also relates to a molten metal degassing apparatus comprising a trough-like container for conveying a molten metal from an inlet to an outlet, and at least one gas injector of the above-mentioned kind.

14 Claims, 9 Drawing Sheets

U.S. PATENT DOCUMENTS 4,058,448 11/1977 Muzhzhavlev et al. .
4,067,731 1/1978 Chia .
4,203,581 5/1980 Pelton .
4,283,357 8/1981 Sidery .
4,290,590 9/1981 Montgrain .
4,334,975 6/1982 Ishizuka .
4,372,541 2/1983 Bocourt et al. .
4,401,295 8/1983 Yoshida .
4,401,543 8/1983 Ishizuka .
4,426,068 1/1984 Gimond et al. .
4,443,004 4/1984 Hicter et al. .
4,481,085 11/1984 Ishizuka .
4,514,269 4/1985 Sivilotti .
4,604,177 8/1986 Sivilotti .
4,607,825 8/1986 Briolle et al. .
4,611,790 9/1986 Otsuka et al. .
4,618,427 10/1986 Venås .
4,634,105 1/1987 Withers et al. .
4,673,434 6/1987 Withers et al. .
4,714,494 12/1987 Eckert .
4,740,279 4/1988 Müller et al. .
4,804,168 2/1989 Otsuka et al. .
4,867,422 9/1989 Ducnkelmann .
4,898,367 2/1990 Cooper .
4,930,986 6/1990 Cooper .
4,931,091 6/1990 Waite et al. .
4,944,859 7/1990 Matsunami et al. .
4,954,167 9/1990 Cooper .
5,028,035 7/1991 Baud et al. .
5,143,357 9/1992 Gilbert et al. .
5,158,737 10/1992 Stein .
5,160,693 11/1992 Eckert et al. .
5,198,180 3/1993 Pelton .
5,527,381 6/1996 Waite et al. .
5,593,634 1/1997 Waite et al. ..... 266/217
5,678,807 10/1997 Cooper ..... 266/235

INJECTOR FOR GAS TREATMENT OF MOLTEN METALS

BACKGROUND OF THE INVENTION

I. Field of the Invention

This invention relates generally to the treatment of molten metals with gases prior to casting or other processes involving metal cooling and solidification, to remove dissolved gases (particularly hydrogen), non-metallic solid inclusions and unwanted metallic impurities prior to cooling and solidification of the metal. More particularly, the invention relates to gas injectors, and apparatus employing such injectors, used for the treatment of molten metals in this way.

II. Description of the Prior Art

Many molten metals used for casting and similar processes must be subjected to a preliminary treatment to remove unwanted components that may adversely affect the physical or chemical properties of the resulting cast product. For example, molten aluminum and aluminum alloys derived from alumina reduction cells or metal holding furnaces usually contain dissolved hydrogen, solid non-metallic inclusions (e.g. $TiB_2$, aluminum/magnesium oxides, aluminum carbides, etc.) and various reactive elements, e.g. alkali and alkaline earth metals. The dissolved hydrogen comes out of solution as the metal cools and forms unwanted porosity in the product. Non-metallic solid inclusions reduce metal cleanliness, and the reactive elements and inclusions create unwanted metal characteristics.

These undesirable components are normally removed from molten metals by introducing a gas below the metal surface by means of gas injectors. As the resulting gas bubbles rise through the mass of molten metal, they adsorb gases dissolved in the metal and remove them from the melt. In addition, non-metallic solid particles are swept to the surface by a flotation effect created by the bubbles and can be skimmed off. If the gas used for this purpose is reactive with contained metallic impurities, the elements may be converted to compounds by chemical reaction and removed from the melt in the same way as the contained solids or by liquid-liquid separation.

This process is often referred to as "metal degassing," although it will be appreciated from the above description that it may be used for more than just degassing of the metal. The process is typically carried out in one of two ways: in the furnace, normally using one or more static gas injection tubes; or in-line, by passing the metal through a box situated in the trough normally provided between a holding furnace and the casting machine so that more effective gas injectors can be used. In the first case, the process is inefficient and time consuming because large gas bubbles are generated, leading to poor gas/metal contact, poor metal stirring and high surface turbulence and splashing. Dross formation and metal loss result from the resulting surface turbulence, and poor metal stirring results in some untreated metal. The second method (as used in various currently available units) is more effective at introducing and using the gas. This is in part because the in-line method operates as a continuous process rather than a batch process.

For in-line treatments to work efficiently, the gas bubbles must be in contact with the melt for a suitable period of time and this is achieved by providing a suitable depth of molten metal above the point of injection of the gas, and by providing a means of breaking up the gas into smaller bubbles and dispersing the smaller bubbles more effectively through the volume of the metal, for example by means of rotating dispersers or other mechanical or non-mechanical devices. Metal residence times in the containers in which such degassing operations are performed are often in excess of 200 seconds, and frequently in excess of 300 seconds.

Effectiveness of degassing is frequently defined in terms of the hydrogen degassing reaction for aluminum alloys and an adequate reaction is generally considered to be one achieving at least 50% hydrogen removal (typically 50 to 60%). This results in the need for deep treatment boxes of large volume (often holding three or more tons of metal) which are unfortunately not self-draining when the metal treatment process is terminated. This gives rise to operational problems and the generation of waste because metal remains in the treatment boxes when the casting process is stopped for any reason and solidifies in the boxes if not removed or kept molten by heaters. Moreover, if the metals or alloys being treated are changed from time to time, the reservoir of a former metal or alloy in a box (unless it can be tipped and emptied) undesirably affects the composition of the next metal or alloy passed through the box until the reservoir of the former metal is depleted.

The entry and exit sections of such degasser boxes generally have cross-sectional areas (measured in a vertical plane orientated transversely to the direction of metal flow) substantially less than the corresponding cross-sectional area of the degasser box itself in order to match the cross-sectional area of the metallurgical troughs used to feed metal to and remove metal from the degasser box. Thus, when the degassing operation is ended and the metal flow is interrupted (resulting in draining of the metallurgical troughs), almost all the metal in the degasser box is retained and must be maintained in the molten state by operating heaters, ladled or pumped out, or poured out by mechanically tilting the entire degasser box.

Various conventional treatment boxes are in use, but these require bulky and expensive equipment to overcome these problems, e.g. by making the box tiltable to remove the metal and/or by providing heaters to keep the metal molten. As a consequence, the conventional equipment is expensive and occupies considerable space in the metal casting facility. Processes and equipment of this type are described, for example, in U.S. Pat. Nos. 3,839,019 and 3,849,119 to Bruno et al.; 3,743,263 and 3,870,511 to Szekeley; 4,426,068 to Gimond et al.; and 4,443,004 to Hicter et al. Modern degassers of this type generally use less than one liter of gas per kilogram (Kg) of metal treated. In spite of extensive development of dispersers to achieve greater mixing efficiency, such equipment remains large, with metal contents of at least 0.4 $m^3$ and frequently 1.5 $m^3$ or more being required. One or more dispersers such as the rotary dispersers previously mentioned may be used, but for effective degassing, at least 0.4 $m^3$ of metal must surround each disperser during operation.

U.S. Pat. No. 5,527,381 to Waite et al. describes a degasser in which the box-like structure of the earlier devices is replaced by a section of trough having approximately the same cross-sectional area as the metallurgical troughs feeding and removing metal from the degasser. This creates a degasser of smaller volume and one which retains little if any metal when the source of metal is interrupted after the degassing operation is completed (i.e. it is substantially self-draining along with the trough). The degasser uses several relatively small rotary gas injectors along the length of a trough section to achieve the equivalent of a continuous "plug" flow reactor, giving a high degassing efficiency.

To achieve effective degassing, all degassing apparatus must deliver a certain minimum volume of gas per kilogram of metal, and in a trough-like vessel where the residence time of the metal in the region in which the gas is supplied is substantially less than in the deep box degassers, the amount of gas which each rotary injector must deliver is high and the ability to deliver a suitable amount of gas determines the effectiveness of an injector design.

The gas injectors disclosed in U.S. Pat. No. 5,527,381 to Waite et al. are capable of delivering a suitable volume of gas to a molten metal and are consequently capable of effective use in trough-like degassers, as described in the patent. However, it has been noticed that gas tends to be released from such rotors in an irregular manner, causing splashing at the surface of the molten metal and inefficiency of dissolved gas removal.

There is a need, therefore, for a compact rotary gas injector capable of delivering large volumes of gas in the form of fine bubbles into molten metal without substantial irregularities of-gas flow, suitable for use in trough-like degassers or in any application in which such high gas delivery in the form of fine bubbles is required.

SUMMARY OF THE INVENTION

An object of the present invention is to provide a gas injector of the kind that may be used for in-line degassing of molten metal in a shallow trough, which injector has a reduced tendency to emit gas unevenly during normal use.

Another object of the invention is to provide a molten metal degassing apparatus which can be operated efficiently and without substantial splashing of gas at the molten metal surface.

Another object of the invention is to provide a gas injector and a molten metal degassing apparatus that can treat molten metal held in containers of shallow depth while achieving thorough degassing without undue splashing of the metal.

Another object is to provide a method of degassing metal in a shallow trough-like vessel with little splashing and uneven metal treatment.

According to one aspect of the present invention, there is provided an injector for injecting gas into a molten metal, comprising a rotor that is rotatable about an axis of rotation, the rotor having a cylindrical projection-free side surface, a bottom surface, and an internal cavity for receiving molten metal located centrally of the rotor with respect to the axis of rotation; a plurality of openings in the side surface spaced around the rotor for ejecting molten metal and gas from the rotor upon rotation of the rotor about the axis of rotation; at least one opening in the bottom surface communicating with the cavity permitting entry of molten metal into the cavity; a plurality of passages disposed in the rotor interconnecting the cavity and the openings in the side surface; and a gas passageway for introducing gas into molten metal present within the rotor; wherein the gas passageway, lacking direct communication with the cavity, has at least one outlet opening into at least one of the plurality of passages.

The cavity for receiving the molten metal has at least a portion on the axis of rotation that is free of obstructions and insertions, i.e. that is unoccupied free volume, and preferably is in the form of an empty cylindrical space centred on the axis of rotation.

The gas injector of the present invention is similar to the injectors of the Waite et al. patent mentioned above, but it is distinguished by a lack of direct communication with the central cavity in the rotor and by at least one, and usually numerous, gas outlets opening into the passages interconnecting the central cavity with the side outlets. Without wishing to be bound by a particular theory, the injector of the present invention is believed to provide even gas distribution by avoiding a collection of gas which is believed to take place within the central cavity of the prior rotor. At the same time, the design of the rotor of the present invention is believed to maintain (or even enhance) the metal pumping action created upon rotation of the rotor. When gas is delivered into the central cavity of the rotor, gas appears to be held in this area. If a large flow of gas is used, the retained gas can eventually fill the entire cavity and impede the metal pumping action and at the same time create large bubbles that are released suddenly and unpredictably, causing splashing at the surface of the molten metal, particularly when the rotor is used in shallow troughs.

By displacing the gas delivery to points just outside the periphery of the central cavity, the introduced gas is rapidly swept along the passages to the outlets by the outwardly flowing metal. At the same time, the entire cavity can fill with metal, which ensures that the pumping action of the metal (molten metal entering the cavity through the opening in the bottom wall to be pumped out through the passages by the rotation motion) is maximized. Thus higher rates of gas flow can be achieved per rotor and the same number of rotors can degas metal having a lower residence time (higher metal flow) in the degassing section of the apparatus.

Preferably, in the injector of the present invention, the cavity in the rotor has an upper surface and each of the passages has an upper surface (at least in radially outer regions of the passages), such that, in the operational orientation of the injector, the upper surfaces of the passages are positioned higher in the rotor than the upper surface of the cavity, and the gas outlets are located in the passages at positions higher than the upper surface of the cavity. Thus, to enter the cavity, the gas emanating from the outlets not only has to move against the direction of metal flow through the passages, but also has to move downwardly against a considerable (given the difference in density between gas and molten metal) buoyancy force.

The gas outlets provided in the passages preferably each face in a direction that is orientated at an angle with respect to the axis of rotation of the rotor towards the side surface of the rotor, i.e. the outlets do not face downwardly, but rather horizontally or at an angle between the vertical and the horizontal (by the term "face" used in connection with such outlets, we mean that the outlets tend to direct gas in the direction in which they "face", at least when surrounded by air—i.e. if an outlet directs gas horizontally, it "faces" the horizontal). For example, this can be achieved by providing each passage with an intermediate step (an upward step when travelling in a direction from the central cavity to the side surface of the rotor) formed by an internal surface that extends parallel to, or at an angle to, the axis of rotation of the rotor, and positioning each opening of the gas passageway in the internal surface so that the openings face outwardly towards the side surface of the rotor. This not only has the effect of injecting the gas in a direction of travel towards the rotor outlets, but also provides a barrier against reverse movement of the gas along the passage to the central cavity. As explained earlier, to negotiate past the step in the reverse direction with respect to outward metal flow, a bubble of gas must travel in a downward direction against the considerable buoyancy force acting upon it from the surrounding metal. The gas is therefore even less likely to travel to and accumulate in the central cavity.

In other respects, the injector of the present invention may be similar to the injectors shown in the Waite et al. patent. That is to say, the passages may extend to the bottom face of the rotor and thus be open at the bottom face. When this is the case, the parts of the rotor between the passages form isolated downward wedge-like projections from the upper end of the rotor and these projections resemble, and are usually referred to, as "vanes." Alternatively, the passages may extend only part way to the bottom surface and thus be closed at this surface, in which case the rotor does not have free-standing vanes, but rather closed vanes.

The gas delivery outlets are preferably symmetrically disposed around the rotor, so that the passages are also symmetrically disposed. The rotor may have an upper surface that is flat, convex or conical and that is most preferably smooth and projection-free to avoid splashing or vortex formation at the surface. The rotor is preferably mounted at the lower end of a rotatable concentric shaft and the gas passageway preferably extends through the shaft into the rotor but not, as noted, into the cavity.

In particularly preferred forms of the invention, the diameter of the rotor is 3.5 inches to 6 inches, the rotor opening swept area (the area of the surface that the outlets sweep past as the rotor rotates) is preferably 60% or less.

The number of passages (vanes) in the rotor is normally greater than 4, and preferably greater than 6, and the vanes within the rotor preferably come to an acute angle at the periphery of the central cavity.

The injector is normally operated at a rotational speed within the range of 500 to 1200 rpm.

The height of sides of rotor are preferably made as small as possible, preferably less than 10 cm.

According to another aspect of the invention, there is provided a molten metal degassing apparatus, comprising: a trough-like container for conveying molten metal from an inlet to an outlet, and at least one gas injector positioned within the container submerged, in use, in the molten metal, wherein each injector comprises: a rotor that is rotatable about an axis of rotation, the rotor having a cylindrical projection-free side surface, a bottom surface, and an internal cavity for receiving molten metal located centrally of the rotor with respect to the axis of rotation; a plurality of openings in the side surface spaced around the rotor for ejecting molten metal and gas from the rotor upon rotation of the rotor about the axis of rotation; at least one opening in the bottom surface communicating with the cavity permitting entry of molten metal into the cavity; a plurality of passages disposed in the rotor interconnecting the cavity and the openings in the side surface; and a gas passageway for introducing gas into molten metal present within the rotor; wherein the gas passageway, lacking direct communication with the cavity, has at least one outlet opening into at least one of the plurality of passages.

Preferably, the trough-like container has a width of less than 60 cm and preferably has a static to dynamic metal holdup of less than 30%, preferably less than 15% and optimally substantially zero. The dynamic metal holdup of the container is defined as the amount of metal in the treatment zone (the region around the injector(s), i.e. between the first and the last injectors, when there is more than one injector present in the apparatus) when the gas injectors are in operation, while the static metal holdup is defined as the amount of metal that remains in the treatment zone when the source of metal has been removed and the metal is allowed to drain naturally from the treatment zone. The trough-like container is normally positioned within a metal conveying trough, so the inlet and outlet have dimensions similar to that of the remainder of the trough.

Between the inlet and the outlet, the trough may have a greater cross-section (depth), but this should be minimized. The trough depth is specified by the metal carrying capacity (level of metal under normal operating conditions) and is normally less than about 50 cm and preferably less than 30 cm.

The number of injectors arranged in a row in the trough depends on the degree of degassing to be achieved. Usually, there are at least 2 such injectors.

The injectors are placed so the bottom face of an injector is generally less than about 2 cm from the bottom of the trough, more preferably less than about 0.5 cm from the trough bottom.

As well as providing for even, regular gas dispersion, the injectors of the present invention, particularly when the gas outlets face outwardly horizontally, can be positioned closer to the bottom wall of the trough-like container than the conventional injector, so a greater degassing effect can be achieved due to the extra depth of molten metal through which the gas bubbles must rise when exiting the injector.

According to yet another aspect of the invention, there is provided a method for injecting gas into a molten metal comprising the steps of: furnishing an injector comprising: a rotor that is rotatable about an axis of rotation, said rotor having a cylindrical projection-free side surface, a bottom surface, and an internal cavity for receiving molten metal located centrally of the rotor with respect to said axis of rotation; a plurality of openings in said side surface spaced around the rotor for ejecting molten metal and gas from said rotor upon rotation of said rotor about said axis of rotation; at least one opening in the bottom surface communicating with said cavity permitting entry of molten metal into said cavity; a plurality of passages disposed in the rotor interconnecting said cavity and said openings in said side surface; and a gas passageway for introducing gas into molten metal present within said rotor; immersing said rotor in a quantity of molten metal, so that molten metal fills the said cavity and said passages; supplying gas to the molten metal present within said rotor via said gas passageway; and rotating said rotor to cause the gas to be broken into bubbles and a gas-metal mixture to be ejected from the said openings in said side surface; wherein the said gas is supplied to the molten metal in such a way that substantially no gas is present in said cavity during operation of said rotor.

In this embodiment of the invention, gas is kept out of the cavity of the rotor by any means, for example by designing the rotor in the manner indicated above and supplying the gas only to the passages and not to the cavity itself.

DETAILED DESCRIPTION OF THE PREFERRED EMBODIMENTS

Figure 1:
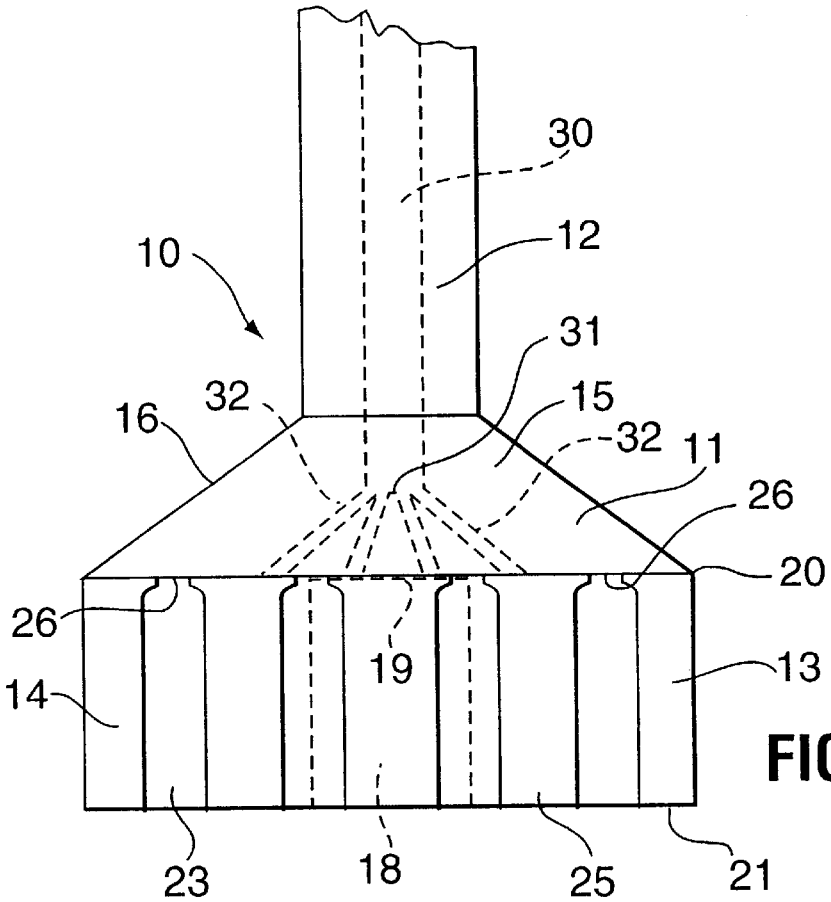
FIG. 1 is a side elevation of a first preferred embodiment of the gas injector of the present invention, with certain internal passages shown in broken lines.
Figure 2:
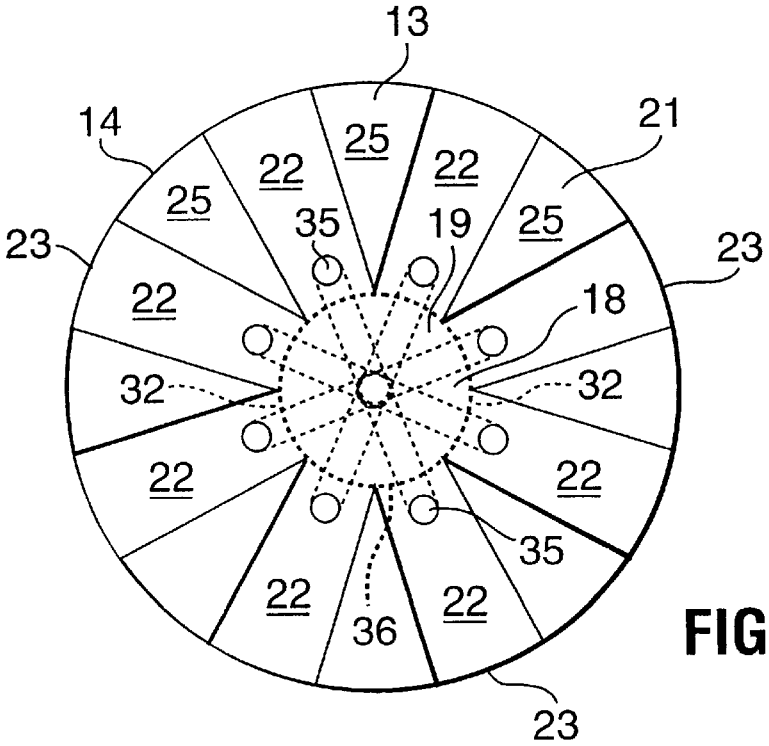
FIG. 2 is an underside plan view of the embodiment of FIG. 1.

FIGS. 1 and 2 show a first preferred embodiment of a rotary gas injector 10 according to the present invention. The injector consists of a smooth faced rotor 11 attached to a bottom end of a cylindrical shaft 12. The rotor 11 is in the form of an upright lower cylindrical portion 13, having an outer face 14, and an upper conical upper portion 15 provided with a smooth surface 16.

The lower cylindrical portion 13 is provided with a centrally-located cylindrical cavity 18, open at a bottom face 21 of the rotor 11 where the lower end of the cavity consequently forms an opening in the bottom face. The cavity 18 extends upwardly from the bottom face of the rotor to an upper cavity surface 19, located at the same horizontal level as an upper edge 20 of the lower cylindrical portion 13 where it joins the conical upper portion 15.

Several passages 22 extend radially from the central cavity 15 to outlets 23 positioned in the outer face 14 of the lower portion of the rotor 13. The passages 22 are defined between generally triangular wedge-like solid vanes 25. The passages 22 are open at the bottom face 21 of the lower portion of the rotor and extend upwardly to the same extent as the cavity 18, terminating in upper surfaces 26.

A gas passageway 30 terminates at its lower end at a location 31 within the conical upper portion 15 of the rotor 11, so that it does not extend into the cylindrical cavity 18, i.e. it does not penetrate the upper cavity surface 19. A series of smaller gas passageways 32 extend outwardly and downwardly from the lower end 31 of the gas passageway 30 to outlets 35 in upper surfaces 26 of the passages 22.

In use, the injector 10 is immersed in molten metal and rotated at a suitable speed. Gas is forced into the passageway 30 at sufficient pressure to emerge from outlets 35. As the injector rotates, molten metal within the central cavity 18 is caused to move along passages 22 to emerge from outlets 23. Air bubbles emerging from outlets 35 are entrained within the metal and are moved to the outlets 23. A region of high mechanical shear is created at the surface 14 of the rotor 11 where jets of molten metal emerging from the outlets 23 encounter relatively static molten metal surrounding the rotor. As the gas bubbles entrained in the jets pass through the high shear region, they are broken down into bubbles of extremely small size and are efficiently dispersed over a wide area by the metal jets.

In operation, the trough in which the rotors are installed is filled to its normal operating level with molten metal, and the rotors are rotated at high speed (e.g. 500 to 1200 rpm). This action causes metal within the central cylindrical cavity 18 and passages 22 to flow radially outwardly through the side openings 23. Fresh metal is then drawn into the central cavity. Gas is supplied by the gas passage 30 to one or more of the injectors and is delivered to the passages as gas bubbles in the metal without flowing directly into the central cylindrical cavity 18. The metal flowing through the passages carries the bubbles to the outer face of the rotor where, as noted above, the high rotational speed shears the bubbles into finer bubbles which are then dispersed by the horizontally moving metal. Because of the smooth surfaces of the rotor with no projecting blades or other devices, the gas is dispersed with little turbulence, making the gas injector highly effective for the trough-like degasser vessel. A rotor of the present invention, when viewed from the top, appears to have a continuous circular outline, with no projections, vanes or other devices extending radially beyond the upper conical portion 15 that agitate the surrounding metal to cause excessive turbulence in the trough. Furthermore, unlike prior art devices, the gas is not delivered to the central cavity, so that there is no tendency for it to collect there, and hence no tendency to reduce the pumping efficiency or generate turbulence, even at high gas delivery rates.

There is little tendency for the gas emerging from outlets 35 to move inwardly towards the cavity 18 because the molten metal flows rapidly outwardly through the passages 22 and carries the gas with it. This is unlike the situation encountered in the previous rotor design where the gas is introduced directly into the cavity 18. In that case, the whirling molten metal in the cavity tends to confine the gas to the central region of the cavity where it pools and exits unevenly. This effect is thus avoided or minimized by positioning the gas outlets 35 within the passages 22, i.e. beyond a periphery (shown by dotted line 36) of the cavity, between the inlets and outlets of the passages 22.

Figure 3:
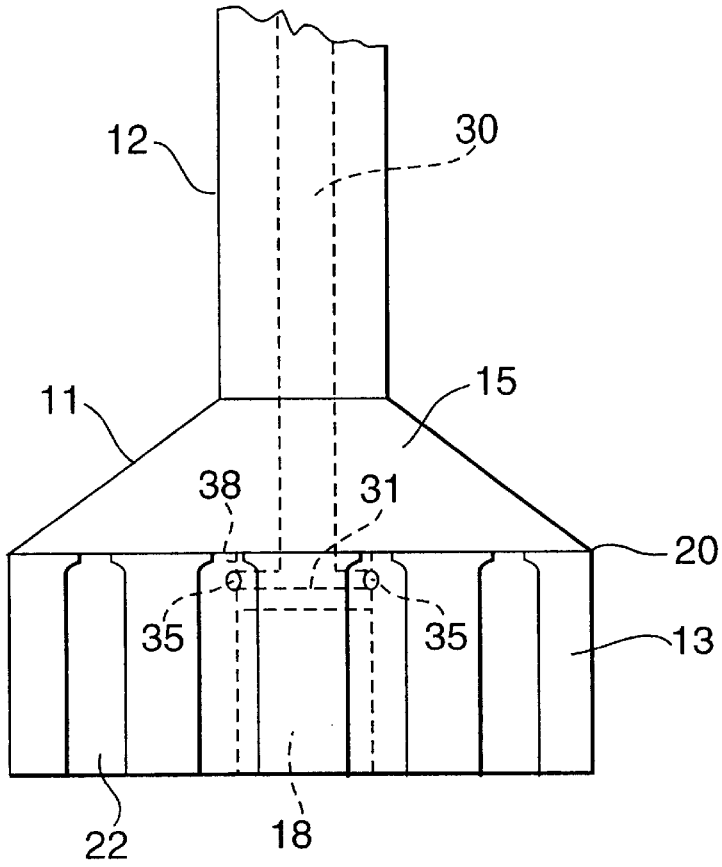
FIG. 3 is side elevational view similar to FIG. 1 of a second preferred embodiment of the invention.
Figure 4:
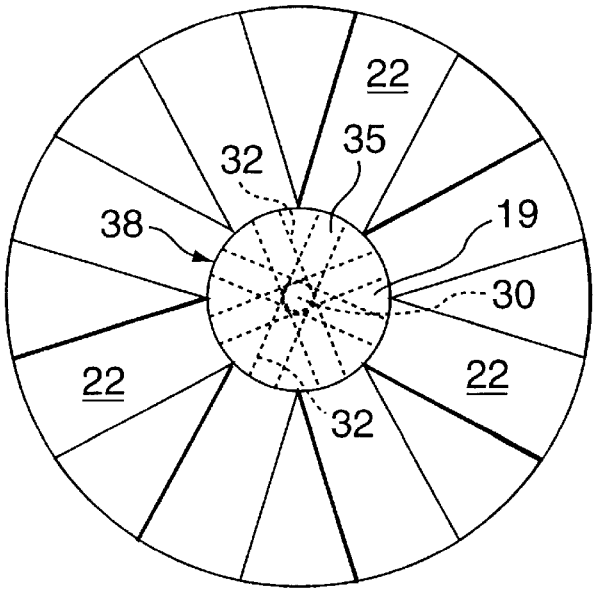
FIG. 4 is an underside plan view of the embodiment of FIG. 3.
Figure 5:
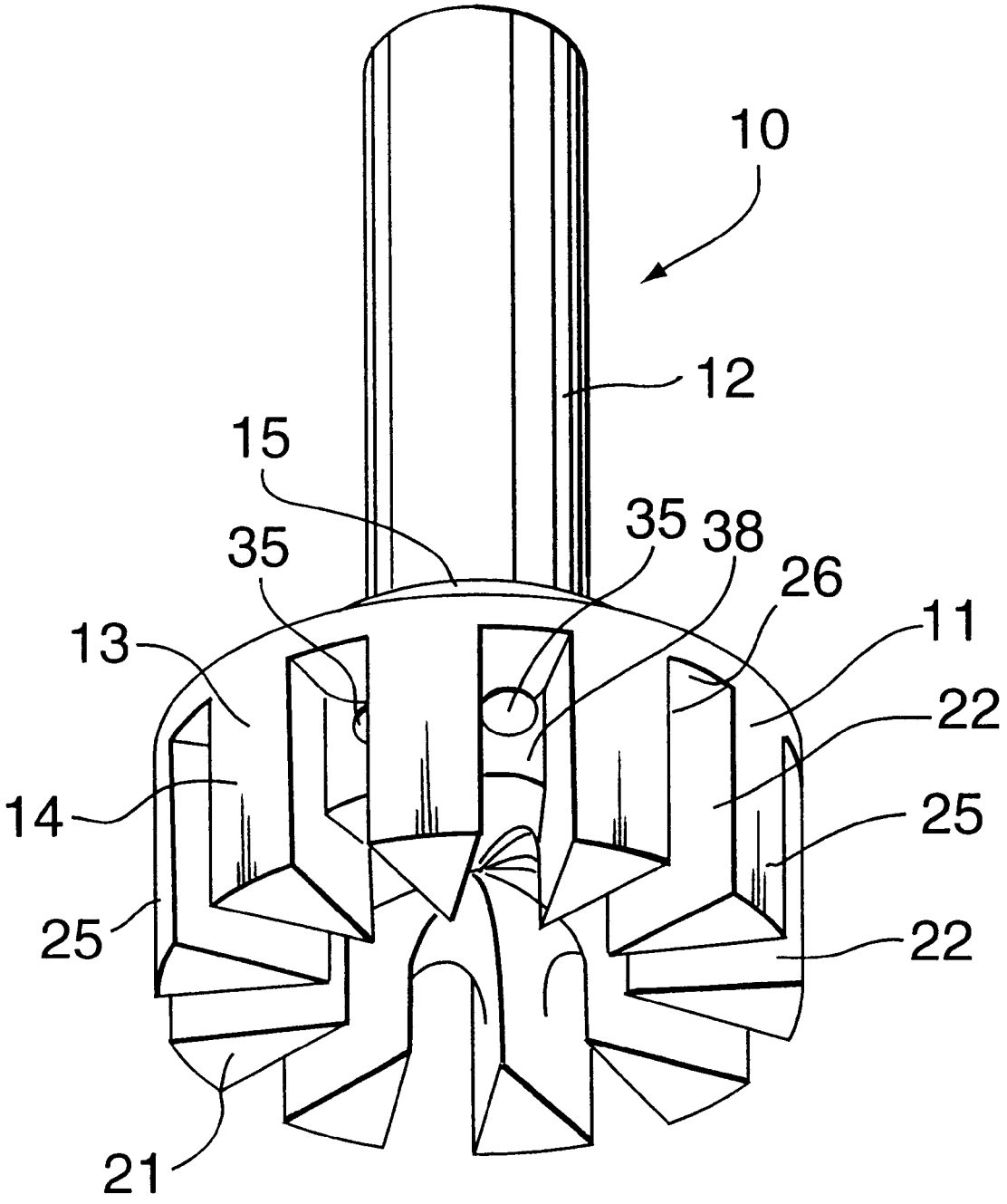
FIG. 5 is a perspective view of the embodiment of FIGS. 3 and 4.

FIGS. 3, 4 and 5 show a second preferred embodiment of the rotary gas injector of the present invention. The injector has many of the same general features as the embodiment of FIGS. 1 and 2. However, this embodiment differs in the following ways. The central cavity 18 has an upper surface 19 positioned below the edge 20 where the lower cylindrical portion 13 joins the upper conical portion 15. Nevertheless, the passages 22 extend upwardly to their upper surfaces 26 positioned at the level of the edge 20. Therefore, a vertical radially outwardly-facing step 38 is formed between the upper surface 19 of the central cavity 18 and the upper surfaces 26 of the radial passages 22.

Axial gas passageway 30 in the cylindrical shaft 12 continues into the rotor 11 for a short distance, terminating at a location 31 such that the passageway does not extend to the upper end 19 of the cylindrical cavity 18. A series of small horizontal gas passageways 32 connect the end of the gas vertical passageway 30 with each of the gas outlets 35, so that gas flowing into the gas injector through passageway 30 is distributed directly into the passages 22 and not to the centrally located cylindrical cavity 18. The outlets 35 are positioned in the vertical step 38 short distance above the upper end 19 of the cavity. Hence, to travel backwards into the cavity, gas emerging from the outlets 35 must not only move against the flow of metal through the passages 18 as the injector rotates, but must also flow downwardly to the bottom of the step 38 against an upward buoyancy force. Therefore, there is little likelihood of the gas entering the cavity 18 to form a pool of gas that may eventually erupt from the bottom face of the rotor.

The result is a much smoother integration of gas and metal by the rotor and the delivery from the openings 23 of a stream of molten metal and fine bubbles.

Figure 6:
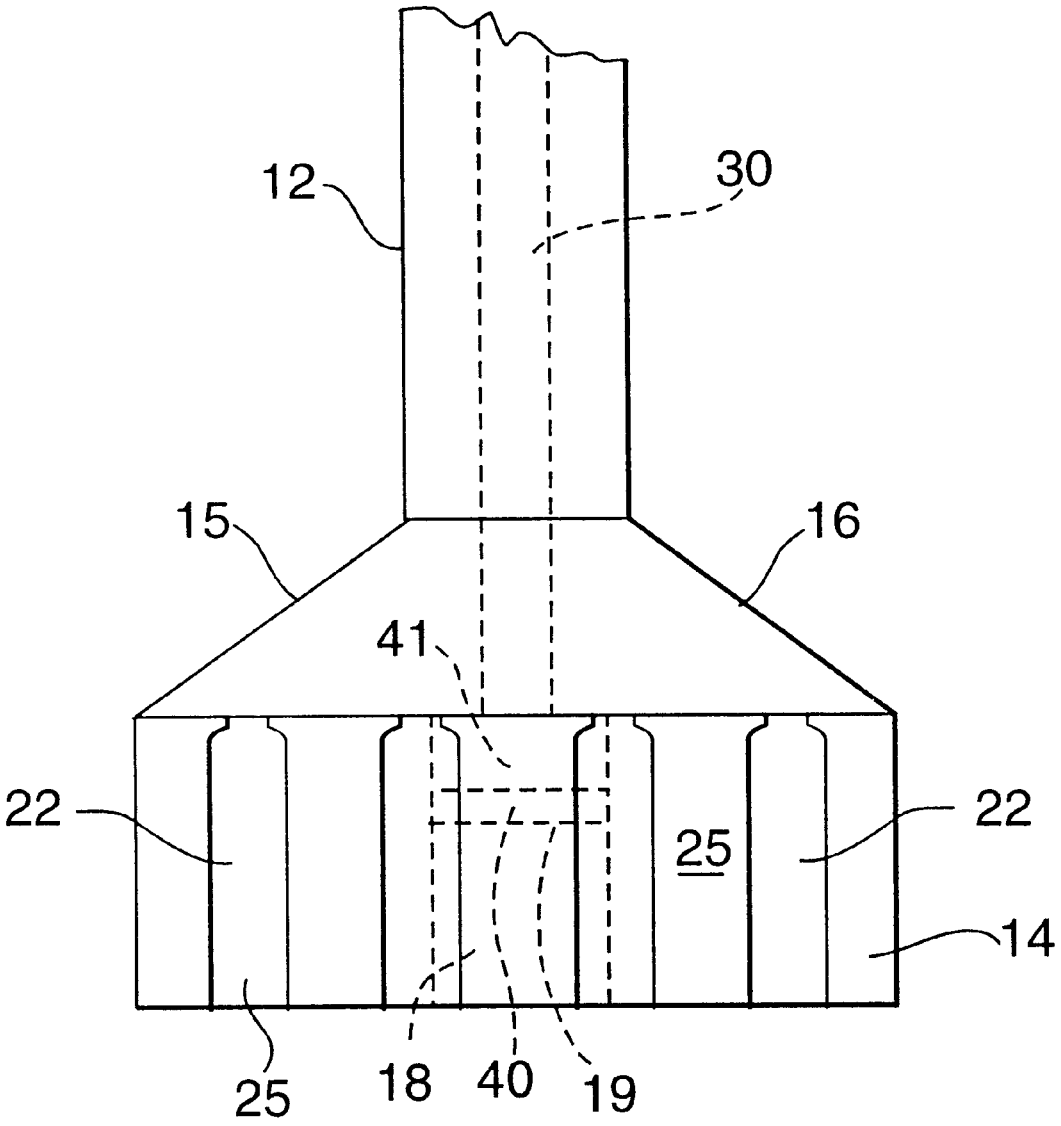
FIG. 6 is a side elevational view similar to FIG. 1 of a third preferred embodiment of the invention.

FIG. 6 shows a third preferred embodiment of the rotary gas injector of the present invention. The injector has the same general features as in the preceding embodiments. However, the upper surface 19 of the centrally located cylindrical cavity 18 in this embodiment is defined by a horizontal baffle plate 40, having the same diameter as the central cavity 18, fixed between the inner edges of the triangular vanes 25. Above the baffle plate, a gas passageway 30 emerges at its lower end into the space 41 above the baffle plate 40. Gas entering this space is forced between the upper ends of the vanes 25 and thus directly into the passages 22 positioned between the vanes. This embodiment therefore works in much the same way as the embodiment of FIGS. 3, 4 and 5, except that the gas outlets 35 of that embodiment occupy essentially the entire vertical surface of the step 38. This embodiment is of interest because it amounts to a way of converting injectors of prior U.S. Pat. No. 5,527,381 into injectors according to the present invention, i.e. by attaching baffle plates within the central cavity 18 at the towards the upper end of the cavity.

Figure 7:
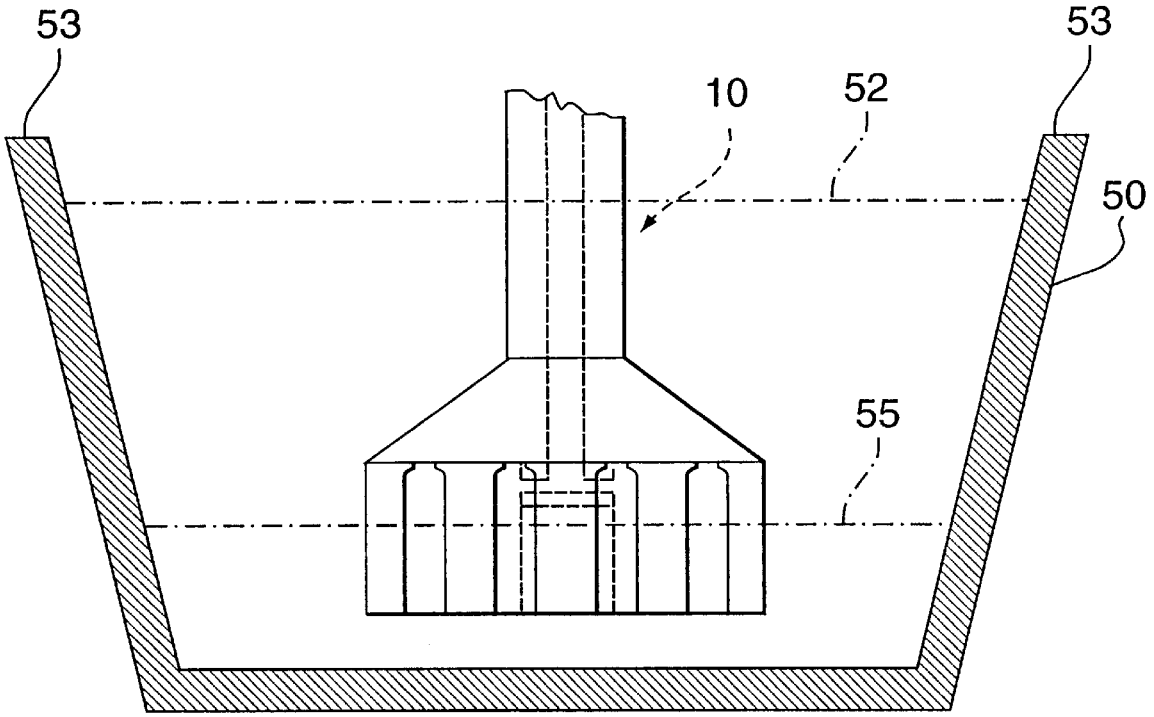
FIG. 7 is a vertical transverse cross-section of a degasser trough containing a gas injector according to a preferred form of the present invention.

FIG. 7 shows a rotary injector 10 of the present invention within a cross-section of a metallurgical trough so which forms a metal container for degassing operations carried out according to the present invention. Such troughs are generally elongated troughs fabricated from metal and lined with a refractory material that is resistant to molten metal. The trough 50 in the present invention is used as a portion of a longer metal delivery trough located between a source of metal (such a holding furnace) and a sink for metal (such as a DC casting machine or continuous casting machine for plate or rod). For such a trough, there is generally defined a normal metal level 52, which is the metal level in the trough when it is connected to the source and sink of metal for which it is designed, and is operated at a safe metal level (to prevent accidental metal spills, for example). The normal metal level is generally close to a top edge 53 of the trough for economic reasons.

Figure 8:
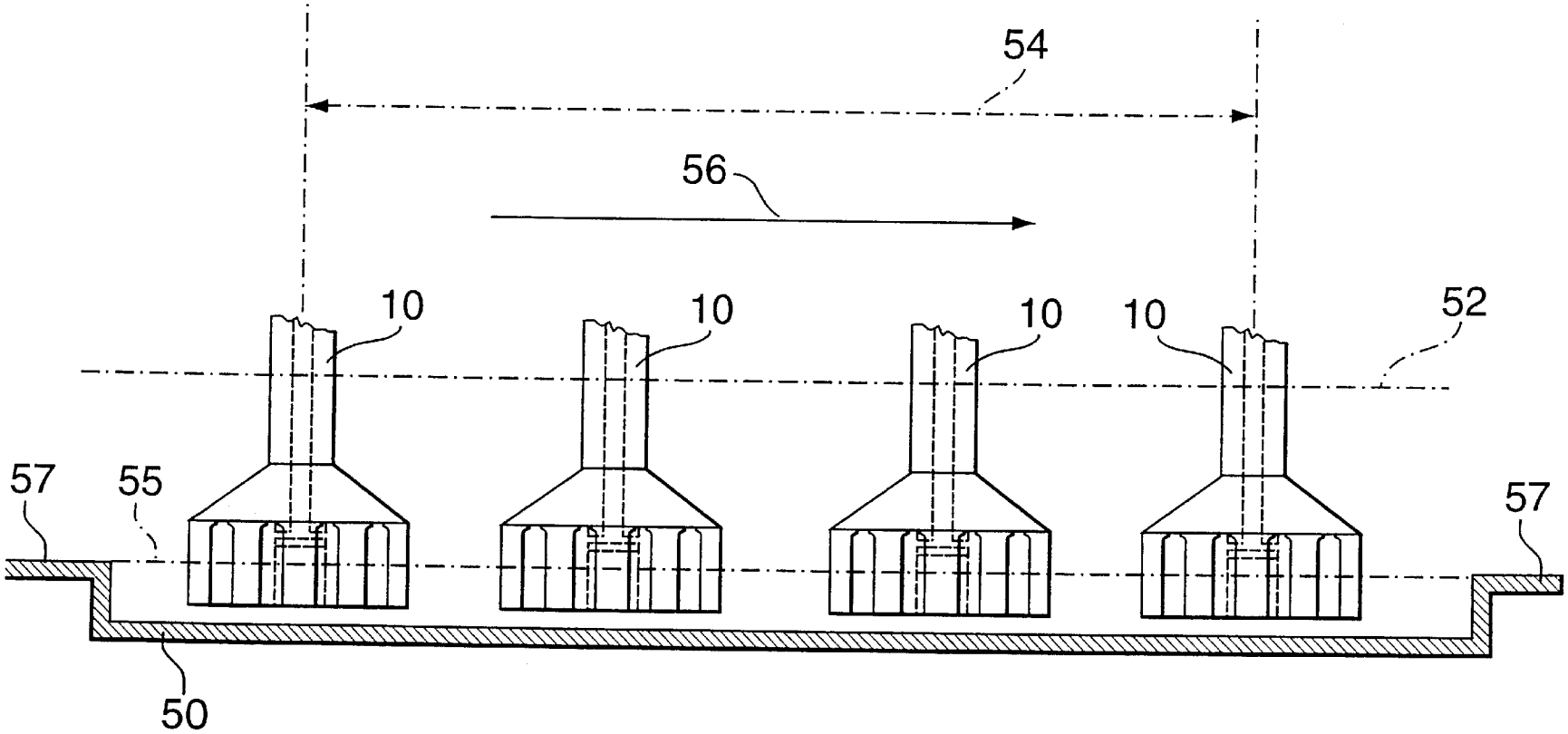
FIG. 8 is a longitudinal vertical cross-section along the centre line of FIG. 7 showing several rotors of the present invention.

FIG. 8 shows a complete degasser unit according to a preferred form of the present invention taken in longitudinal section along the centre line of the rotor shown in FIG. 7. The degasser unit as illustrated consists of four rotary gas injectors 10 provided in series along the central longitudinal axis of the metallurgical trough section. However, the number of injectors may be greater or less than this number. Typically from 2 to 10 injectors may be used, preferably 4 to 8 injectors. The distance between the centre-line of the first injector and the last injector of the series is defined as the "treatment section" length illustrated by arrow 54.

Figure 9:
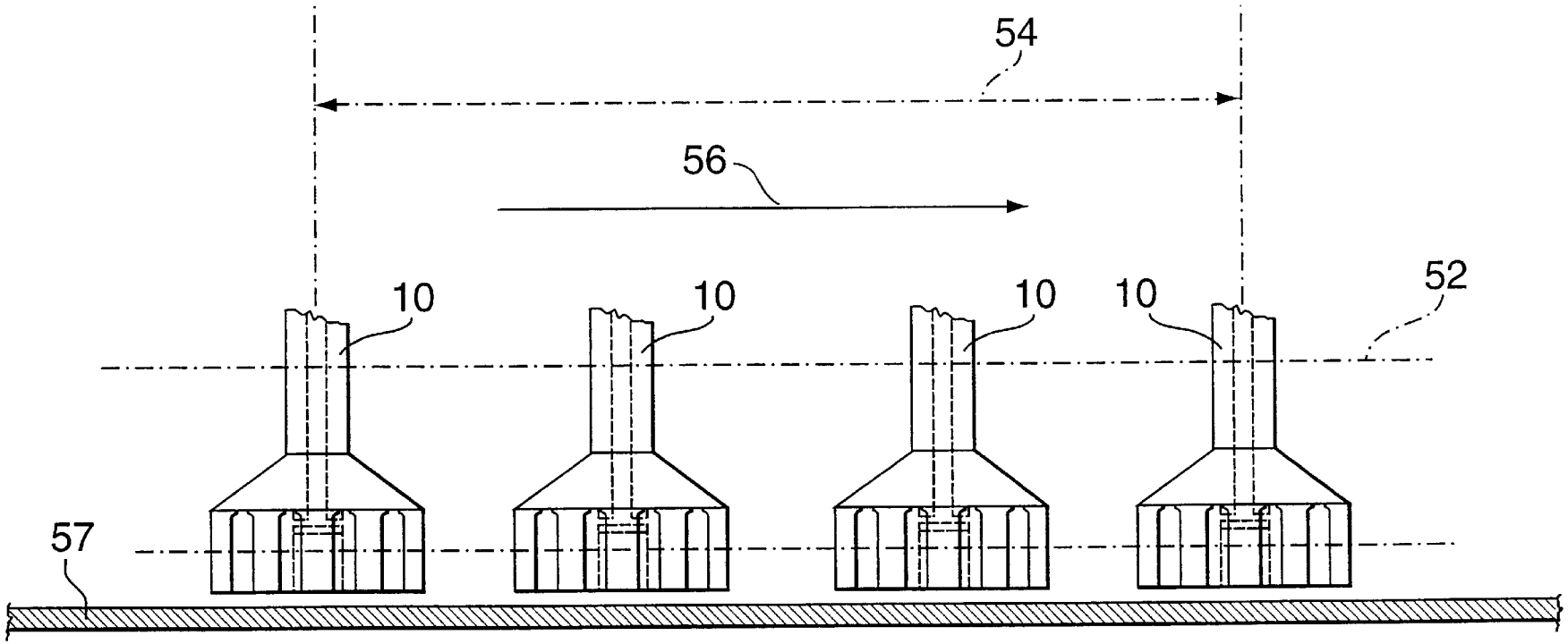
FIG. 9 is a view similar to FIG. 8 of an embodiment having zero metal holdup.

The trough 57 depicted in FIG. 8 is shown with a deeper section 50 in the area of the injectors 10. When the source of metal is interrupted (for example, when the holding furnace flow is stopped), the metal will drain (generally in the direction of metal flow (arrow 56) unless alternate draining procedures are used). However an amount of metal shown by the level 55 will be retained in this section. This is referred to as the "metal holdup" and is defined as the ratio of the volume of metal that remains in the degasser trough after the metal has naturally drained out and the amount present during normal operations. This can be determined practically by determining the amount of metal within the "treatment section" as defined above during normal operation and after the metal had drained from the trough as much as possible by natural drainage. In the present case, this would be the ratio of the cross sectional area of the trough below line 55 times the distance between the first and final rotors, and the cross-sectional area of the trough below line 52 times the same distance. Preferably this ratio should be less than 30%, more preferably less than 15%. Most preferably the ratio is zero indicating that the treatment section does not have a deeper section such as illustrated in FIG. 8 and therefore drains completely by natural drainage after the metal source is interrupted. Such an embodiment is illustrated in FIG. 9.

The invention is described in more detail in the following with reference to the following Example, which is not intended to limit the scope of the present invention.

EXAMPLE

Figure 10:
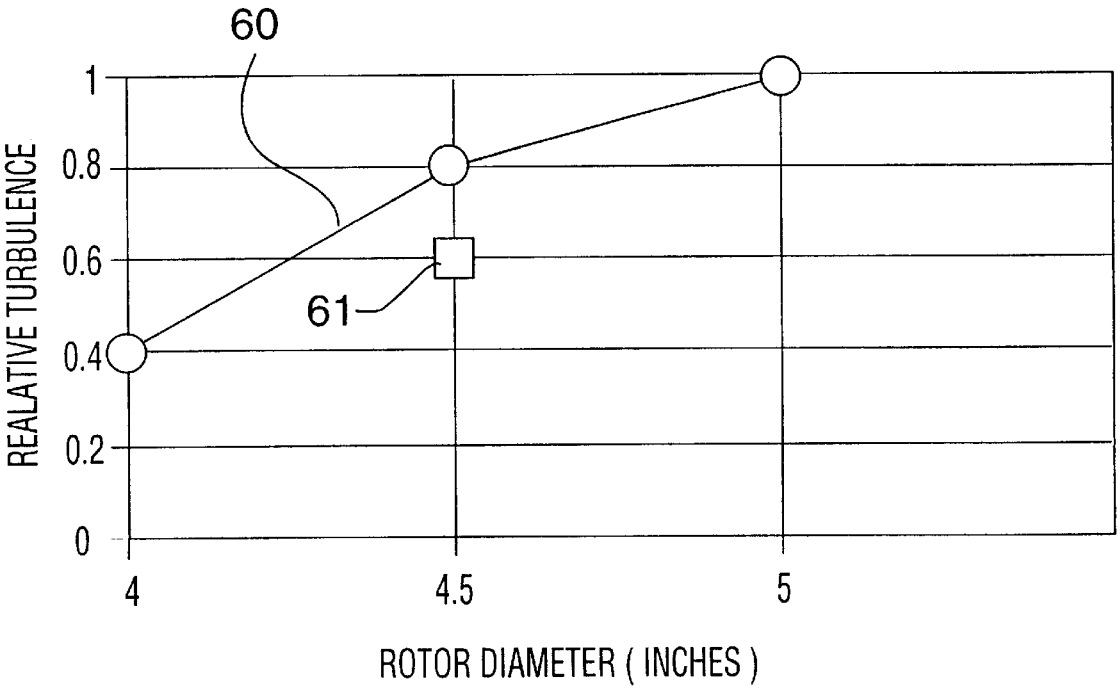
FIG. 10 is a graph showing the turbulence created by an injector according to one form of the present invention compared to a prior art injector in a water model.

A degasser based on the injector embodiment of FIGS. 3, 4 and 5 was modelled using a water model, in which the gas bubbles could be observed directly and the surface turbulence measured. A rotor having a diameter of 4.5 inches was used and it was operated at 800 rpm. At the same time, prior art rotors were tested, in which the gas was delivered by a single outlet to the centre of the centrally located cylindrical cavity. The prior art rotors had diameters of 4, 4.5 and 5 inches and were also operated at the same speed. All rotors delivered the same flow rate of gas (nitrogen was used) at a flow rate of 137 liter/minute. This flow rate was about three time higher than the typical gas delivery rate when the rotor was used in molten metal and was required to correctly compensate for the gas expansion which occurs at the metal temperatures experienced in the actual degasser of the present type. The relative surface turbulence, measured by a surface contact device, was determined and is shown plotted versus rotor diameter in FIG. 10. The prior art turbulence is shown as a segmented line 60, and the present invention by a point 61. The surface turbulence increases with the diameter of the rotor, but the rotor of the present invention shows improvement over a prior art rotor of equivalent size.

Figure 11A:
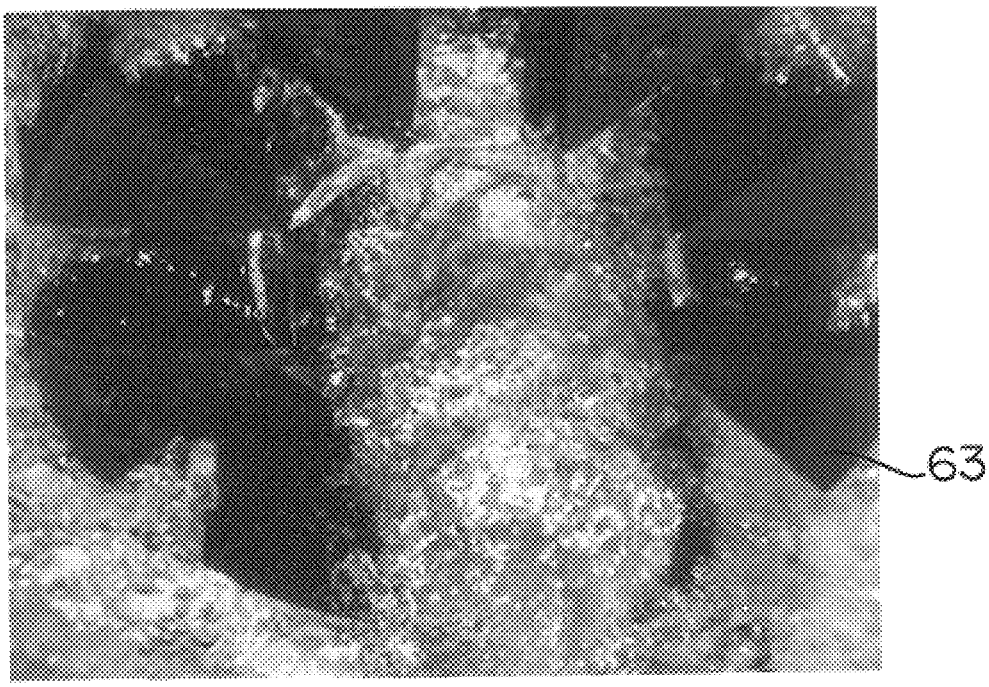
FIG. 11(A) PRIOR ART
FIGS. 11A and 11B are comparative photographs of bubbles generation by an injector according to one embodiment of the present invention (FIG. 11B) compared to and injector of the prior art (FIG. 11A).
Figure 11B:
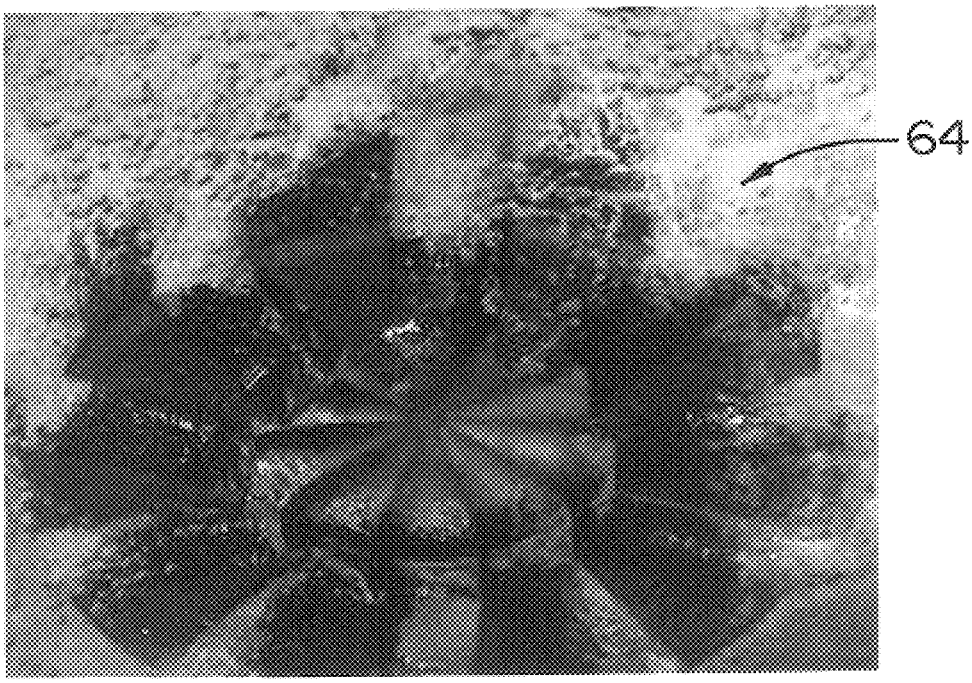

The bubble generation by the present rotor and prior art device is shown in FIGS. 11A and 11B. These Figures show that bubbles in the prior art injector 63 are retained in the central region of the rotor, whereas in the injector 64 of the present invention, the bubbles are fully dispersed and, as a result, turbulence and uneven pumping action are avoided.

What I claim is:

1. An injector for injecting gas into a molten metal, comprising:

a rotor that is rotatable about an axis of rotation, said rotor having a cylindrical projection-free side surface, a bottom surface, and an internal cavity for receiving molten metal located centrally of the rotor with respect to said axis of rotation;

a plurality of openings in said side surface spaced around the rotor for ejecting molten metal and gas from said rotor upon rotation of said rotor about said axis of rotation;

at least one opening in the bottom surface communicating with said cavity permitting entry of molten metal into said cavity;

a plurality of passages disposed in the rotor interconnecting said cavity and said openings in said side surface; and a gas passageway for introducing gas into molten metal present within said rotor;

wherein said gas passageway, lacking direct communication with said cavity, has at least one outlet opening into at least one of said plurality of passages.

2. The injector of claim 1, wherein said cavity has an upper surface and each of said passages has an upper surface, wherein, in an operational orientation of said injector, at least radially outer parts of said upper surfaces of said passages are positioned higher in said rotor than said upper surface of said cavity, and wherein said outlets are positioned in said passages at positions located vertically higher than said upper surface of said cavity.

3. The injector of claim 2, wherein each said passage has an intermediate step formed by an internal surface that extends generally upwardly in a direction from said central cavity to said outer surface, and wherein each said opening of said gas passageway is positioned in said internal surface.

4. The injector of claim 3, wherein said internal surface extends parallel to said axis of rotation of said rotor so that each said opening faces said side surface.

5. The injector of claim 1, wherein each said passage is provided with an outlet from said gas passageway.

6. The injector of claim 1, wherein said rotor is provided at a lower end of a concentric rotatable shaft, and wherein said gas passageway extends longitudinally through said shaft.

7. The injector of claim 6, wherein said gas passageway extends into said rotor, terminating at a lower end above said central cavity, and wherein said outlets are provided at said lower end facing outwardly into said passages.

8. The injector of claim 6, wherein a horizontal plate is provided above said central cavity between inner ends of sections of said rotor positioned between said passages, and wherein said gas passageway communicates with a space positioned above said plate and communicating laterally with said passages.

9. A molten metal degassing apparatus, comprising:

a trough for conveying molten metal from an inlet to an outlet, and at least one gas injector positioned within the trough submerged, in use, in said molten metal, wherein each said injector comprises:

a rotor that is rotatable about an axis of rotation, said rotor having a cylindrical projection-free side surface, a bottom surface, and an internal cavity for receiving molten metal located centrally of the rotor with respect to said axis of rotation;

a plurality of openings in said side surface spaced around the rotor for ejecting molten metal and gas from said rotor upon rotation of said rotor about said axis of rotation;

at least one opening in the bottom surface communicating with said cavity permitting entry of molten metal into said cavity;

a plurality of passages disposed in the rotor interconnecting said cavity and said openings in said side surface; and a gas passageway for introducing gas into molten metal present within said rotor;

wherein said gas passageway, lacking direct communication with said cavity, has at least one outlet opening into at least one of said plurality of passages.

10. The apparatus of claim 9, wherein said trough has a width of less than 60 cm.

11. The apparatus of claim 9, wherein said trough has a depth of metal under normal operating conditions that is less than about 50 cm.

12. The apparatus of claim 9, having a metal holdup of less than 30%.

13. The apparatus of claim 9, having a metal holdup of substantially zero.

14. A method for injecting gas into a molten metal comprising the steps of:

furnishing an injector comprising:

a rotor that is rotatable about an axis of rotation, said rotor having a cylindrical projection-free side surface, a bottom surface, and an internal cavity for receiving molten metal located centrally of the rotor with respect to said axis of rotation;

a plurality of openings in said side surface spaced around the rotor for ejecting molten metal and gas from said rotor upon rotation of said rotor about said axis of rotation;

at least one opening in the bottom surface communicating with said cavity permitting entry of molten metal into said cavity;

a plurality of passages disposed in the rotor interconnecting said cavity and said openings in said side surface; and a gas passageway for introducing gas into molten metal present within said rotor;

immersing said rotor in a quantity of molten metal, so that molten metal fills the said cavity and said passages;

supplying gas to the molten metal present within said rotor via said gas passageway; and rotating said rotor to cause the gas to be broken into bubbles and a gas-metal mixture to be ejected from the said openings in said side surface;

wherein the said gas is supplied to the molten metal in such a way that substantially no gas is present in said cavity during operation of said rotor.

* * * * *